US009586808B2

(12) United States Patent
Jenkins

(10) Patent No.: US 9,586,808 B2
(45) Date of Patent: Mar. 7, 2017

(54) HEADGEAR FOR USE IN DIRECTING AN ANIMAL

(75) Inventor: Brian Jenkins, Pearcedale (AU)

(73) Assignee: Iqonic Pty Ltd., Donvale, Victoria (AU)

( * ) Notice: Subject to any disclaimer, the term of this patent is extended or adjusted under 35 U.S.C. 154(b) by 115 days.

(21) Appl. No.: 14/117,558

(22) PCT Filed: May 11, 2012

(86) PCT No.: PCT/AU2012/000522
§ 371 (c)(1),
(2), (4) Date: Jan. 14, 2014

(87) PCT Pub. No.: WO2012/155193
PCT Pub. Date: Nov. 22, 2012

(65) Prior Publication Data

US 2014/0331620 A1 Nov. 13, 2014

(30) Foreign Application Priority Data

May 13, 2011 (AU) ..... 2011901839

(51) Int. Cl.
*B68B 1/06* (2006.01)

(52) U.S. Cl.
CPC ..... *B68B 1/06* (2013.01)

(58) Field of Classification Search
CPC ..... B68B 1/06
See application file for complete search history.

(56) References Cited

U.S. PATENT DOCUMENTS

| | | | |
|---|---|---|---|
| 28,563 | A | 6/1860 | Crane |
| 157,340 | A | 12/1874 | Mellor |
| 233,309 | A | 10/1880 | Wheeler |
| 279,171 | A | 6/1883 | Longcor |
| 295,028 | A | 3/1884 | Longcor |

(Continued)

FOREIGN PATENT DOCUMENTS

| | | |
|---|---|---|
| DE | 15090 | 3/1881 |
| DE | 50610 | 7/1889 |

(Continued)

OTHER PUBLICATIONS

International Search Report for International Application No. PCT/AU2012/000522 mailed Jun. 7, 2012 (4 pages).

(Continued)

*Primary Examiner* — Kathleen Alker
(74) *Attorney, Agent, or Firm* — Merchant & Gould P.C.

(57) ABSTRACT

Headgear for directing an animal is disclosed. The headgear includes a bit that includes a pair of rings to which reins of the headgear are to attach; a jointed mouthpiece with a connecting portion adjacent each end for connection to a respective one of the rings such that each ring can rotate through the respective connecting portion, and at least one joint between the connecting portions that allows the mouthpiece to articulate between an undeflected position in which the connecting portions have a maximum separation, and deflected positions in which the separation of the connecting portions is less than the maximum; and a mouthpiece support that extends between the rings, and limits the minimum separation of the connecting portions.

14 Claims, 3 Drawing Sheets

(56) References Cited

U.S. PATENT DOCUMENTS

| | | | | | |
|---|---|---|---|---|---|
| 309,660 | A | | 12/1884 | Squier | |
| 422,529 | A | | 3/1890 | Johnson et al. | |
| 425,212 | A | * | 4/1890 | Crose | 54/9 |
| 529,022 | A | | 11/1894 | Cruger | |
| 544,917 | A | * | 8/1895 | Hart | 54/9 |
| 577,001 | A | | 2/1897 | Bigelow | |
| 615,283 | A | | 12/1898 | Knight | |
| 670,248 | A | | 3/1901 | Raymond | |
| 801,436 | A | | 10/1905 | Atherton | |
| 794,681 | A | | 11/1905 | Phillips | |
| 815,385 | A | * | 3/1906 | Sievert | 54/7 |
| 831,102 | A | * | 9/1906 | Riggs | 54/7 |
| 865,757 | A | * | 9/1907 | Boyd | 54/7 |
| 981,488 | A | | 1/1911 | Smith | |
| 1,054,593 | A | * | 2/1913 | Mills | 54/7 |
| 1,078,987 | A | | 11/1913 | Beery | |
| 1,124,888 | A | * | 1/1915 | Graham | 54/7 |
| 1,494,884 | A | | 5/1924 | Boyer | |
| 2002/0007619 | A1 | * | 1/2002 | Myler et al. | 54/7 |
| 2010/0170207 | A1 | * | 7/2010 | Morgante | 54/9 |

FOREIGN PATENT DOCUMENTS

| | | |
|---|---|---|
| DE | 731048 | 2/1943 |
| WO | WO 03/018463 | 3/2003 |

OTHER PUBLICATIONS

Dexter Ring Racing Bit—Markery Saddlery—http://www.markeysaddlery.com.au/show_product.php?p—retrieved Jun. 14, 2012. (1 page).

* cited by examiner

HEADGEAR FOR USE IN DIRECTING AN ANIMAL

This application is a National Stage Application of PCT/AU2012/000522, filed 11 May 2012, which claims benefit of Serial No. 2011901839, filed 13 May 2011 in Australia and which applications are incorporated herein by reference. To the extent appropriate, a claim of priority is made to each of the above disclosed applications.

FIELD OF THE INVENTION

The present invention relates to headgear for use in directing an animal.

BACKGROUND

When riding or driving an animal, such as a horse, it is known to use headgear to direct the animal. For example, a horse rider controls a horse with reins that are attached to a bit, which is held on a horse's head by a bridle.

While there are many different types of bits that are used in horse riding, all bits have a mouthpiece that, in use, is positioned on the bars in the interdental region and at the corners of the horse's mouth, and a pair of sidepieces at each end of the mouthpiece that connect either directly or indirectly to the reins. The sidepieces can be shanks that are configured to lever the action of the reins on the mouthpiece, or can be bit rings that directly connect the reins to the mouthpiece. There are many different shapes of bit rings, including circular rings, Dee rings, and Eggbutt shapes.

One common bit used in horse racing is a Dee bit, in which each ring has an overall "D" shape, with the straight section arranged to act against the horse's cheeks, and the mouthpiece is jointed. The joint in the mouthpiece provides a pinching action when the rider pulls the reins that urges the mouthpiece and bit rings against the soft tissues on the corners of the horse's mouth. This means that the rider can turn or slow the horse with minimal movement of the reins because there is greater communication from rider to horse. However, a significant disadvantage of this type of bit is that significant effort on the rider's part is required to release the bit and let the horse relax on the bit. This is problematic in a horse race because the horse is disinclined to accelerate with residual pressure from the bit.

SUMMARY OF THE INVENTION

The present invention provides a bit for use in headgear for directing an animal, the bit comprising:

a pair of rings to which reins of the headgear are to attach;

a jointed mouthpiece with a connecting portion adjacent each end for connection to a respective one of the rings such that each ring can rotate through the respective connecting portion, and at least one joint between the connecting portions that allows the mouthpiece to articulate between an undeflected position in which the connecting portions have a maximum separation, and deflected positions in which the separation of the connecting portions is less than the maximum; and a mouthpiece support that extends between the rings, and limits the minimum separation of the connecting portions.

In certain embodiments, the support includes a cross bar that is to extend through the animal's mouth; a pair of uprights, each of which is connected at their upper end to the cross bar; and a pair of fixed loops, each of which is connected to the lower end of a respective one of the uprights and defines an opening through which one of the rings extends, wherein an interference between the mouthpiece, the uprights and the rings limits the minimum separation of the connecting portions.

The fixed loops can form shoulders on which the mouthpiece rests.

The height of the uprights is preferably greater than the thickness of the mouthpiece at the connecting portion.

In some embodiments, the fixed loops are arranged such that the largest dimension of the opening extends generally transversely to the cross bar and uprights. In some further embodiments, the length of the opening defined by the fixed loops is such that the rings can freely rotate when the mouthpiece is in any of the undeflected or deflected positions.

The cross bar can have an arc shape such that the mouthpiece articulates beneath the cross bar.

In certain embodiments, the support includes a loop member that is connected to the uprights and is to extend underneath the animal's lower jaw.

In some embodiments, the crossbar, uprights and loop member form a continuous ring. In such embodiments, the fixed loops can be welded to the continuous ring.

The bit may further comprise a retaining ring that extends around the cross bar and through a central portion of the mouthpiece to retain the mouthpiece in close proximity to the cross bar. In embodiments in which the mouthpiece has a single joint formed by two opposing interlinked loops, the retaining ring extends through one of the loops.

Preferably, each connecting portion is in the form of an aperture that extends through the mouthpiece adjacent the respective end.

Preferably, each of the rings in the pair of rings is circular. More preferably, each of these rings has a diameter of at least 10 centimeters.

The present invention also provides headgear that comprises the bit described above.

BRIEF DESCRIPTION OF THE DRAWINGS

In order that the invention may be more easily understood, embodiments will now be described by reference to the accompanying drawings, in which.

DETAILED DESCRIPTION

Figure 1:
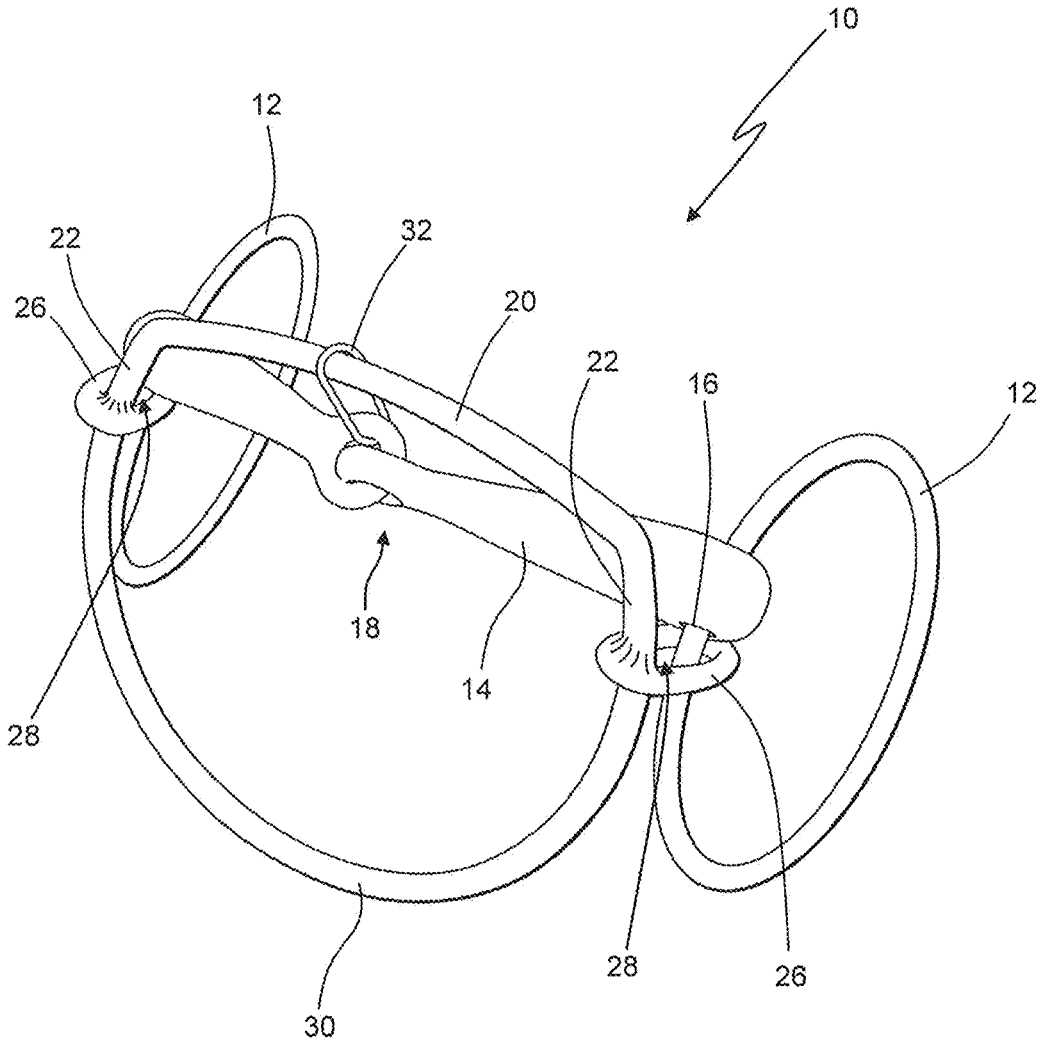
FIG. 1: is a front perspective view of a bit for use in headgear for directing an animal in accordance with a first embodiment of the present invention.
Figure 2:
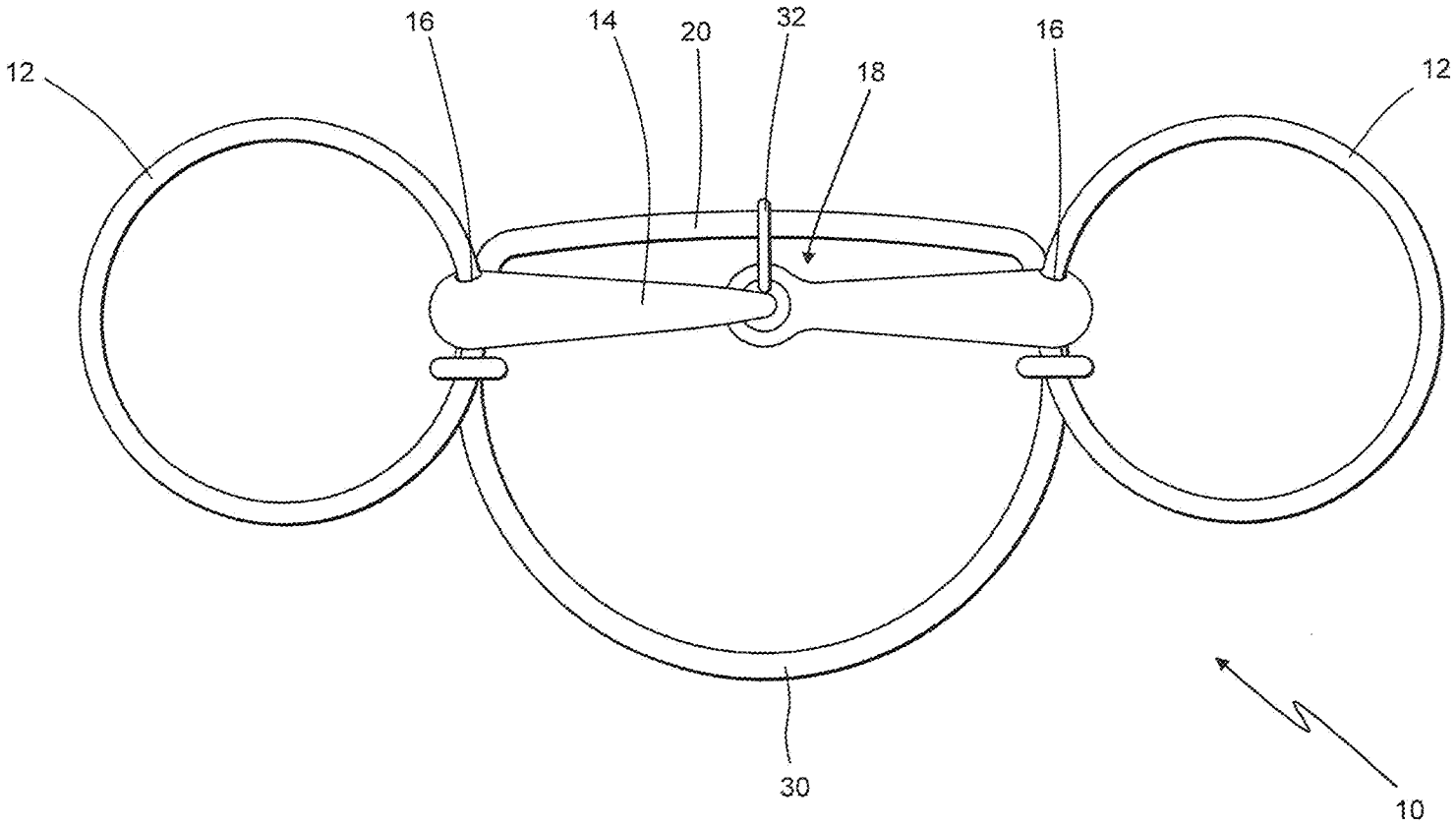
FIG. 2: is a rear view of the bit of FIG. 1.

FIGS. 1 and 2 show a bit 10 for use in headgear for directing an animal. The bit 10 is particularly suitable for use with a horse. For convenience, the bit is described in connection with horse. However, the bit may be suitable for use with other animals.

The bit 10 has a pair of rings 12 to which reins of the headgear attach, and a jointed mouthpiece 14 that has a connecting portion adjacent each end for connection to a respective one of the rings 12 such that each ring 12 can rotate through the respective connecting portion. In this particular embodiment, each connecting portion is in the form of an aperture 16 that extends through the mouthpiece adjacent the respective end. A respective one of the rings 12 extends through each aperture 16, such that each ring 12 can rotate through the aperture 16. As shown in FIGS. 1 and 2, the mouthpiece 14 in this embodiment has a joint 18 between the apertures 16 that allows the mouthpiece 14 to articulate between an undeflected position in which the apertures 16 have a maximum separation, and deflected positions in which the separation of the apertures 16 is less than the maximum. The bit 10 also has a mouthpiece support that extends between the rings, and limits the minimum separation of the apertures 16.

Thus, when the bit 10 is in a horse's mouth, the "pinching" action of the mouthpiece against the horse's cheeks is limited. Furthermore, because the rings 12 can freely rotate through the apertures 16 in the mouthpiece, when the horse rider releases pressure on the reins, the mouthpiece 14 can readily move to a comfortable position on the bars in the horse's mouth. In a horse race, this means that when the rider releases pressure on the reins, the horse can relax on the bit and is comfortable and ready to accelerate when necessary. This is particularly advantageous in racing because the rider should ideally be able to have the horse willing to accelerate as soon as they take the pressure off the reins.

In this particular embodiment, the mouthpiece support includes a cross bar 20 that is to extend through the animal's mouth, and a pair of uprights 22, each of which is connected at their upper end to the cross bar 20. The mouthpiece support also has a pair of fixed loops 26 that are each formed at the lower end of a respective one of the uprights 22. Each fixed loop 26 is connected to the lower end of a respective one of the uprights 22 and defines an opening 28 through which one of the rings 12 extends.

As shown most clearly in FIG. 1, the uprights 22 are on the front side of the mouthpiece 14, with respect to the position in which the bit 10 is worn by a horse. In this particular embodiment, it is an interference between the mouthpiece, the uprights and the rings that limits the minimum separation of the apertures. In particular, the separation of the uprights 22 is less than the separation of the apertures 16, when the mouthpiece 14 is in the undeflected position. The articulating movement of the mouthpiece 14—as it progresses away from the undeflected position—is limited by the contact between the uprights 22 and the mouthpiece 14 adjacent the apertures 16, together with the interaction of the rings 12 with the fixed loops 26.

As shown in FIG. 1, the fixed loops 26 provide shoulders on which the mouthpiece 14 rests. The cross bar 20 has an arc shape such that the mouthpiece 14 articulates beneath the cross bar 20. Thus, when the bit 10 is fitted to a horse, the mouthpiece 14 articulates beneath the cross bar 20.

The height of the uprights 22 (which is the separation of the cross bar 20 and the fixed loops 26) is greater than the thickness of the mouthpiece 14 at the apertures 16. This enables the mouthpiece 14 to pivot easily on the rings 12 beneath the cross bar 20.

The fixed loops 26 are arranged such that the largest dimension of the openings 28 extends generally transversely to the cross bar 20 and uprights 22. In other words, the loops 26 extend generally rearwardly from the uprights 22, with respect to the position in which the bit 10 is worn by a horse. Furthermore, the length of the opening 28 is such that the rings 12 can freely rotate through the apertures 16 when the mouthpiece 14 is in any of the undeflected or deflected positions.

The mouthpiece support includes a loop member 30 that is connected to the uprights 22 and, when the bit 10 is fitted to a horse, is to extend underneath the horse's lower jaw. The loop member 30 minimizes rotation of the cross bar 20 in horse's mouth, which minimizes movement of the uprights 22. In addition, the uprights 22 and loop member 30 provide increased turning power due to increased contact between the bit 10 and the soft tissues around the horse's mouth.

As will be appreciated from FIGS. 1 and 2, in this particular embodiment, the crossbar 20, uprights 22 and loop member 30 form a continuous (non-circular) ring. In addition, the fixed loops 26 are welded to the continuous ring.

The bit 10 further has a retaining ring 32 that extends around the cross bar 20 and through a central portion of the mouthpiece 14 to retain the mouthpiece 14 in close proximity to the cross bar 20. The retaining ring 32 facilitates fitting the bit 10 to the horse by retaining the mouthpiece 14 and cross bar 20 in close proximity to one another. However, the retaining ring 32 is shaped such that it has minimal interference with the articulating movement of the mouthpiece 14.

As will also be appreciated, the bit 10 has negligible leverage on the mouthpiece because the continuous ring does not provide a lever for the reins to work on the mouthpiece 14.

In the illustrated embodiment, the mouthpiece 14 is a single jointed snaffle, that has two arms that are joined by two opposing interlinked snaffle loops. In this embodiment, the retaining ring 32 extends through the "upright" snaffle loop relative to position in which the bit 10 is worn by a horse.

As previously mentioned, the support in the bit shown in FIGS. 1 and 2 has two fixed loops, that are welded to the continuous ring. In some alternative embodiments, the fixed loops may be formed integrally with the continuous ring by twisting the continuous ring during manufacture. In some other alternative embodiments, the fixed loops may have a bar that is connected at one end to the continuous ring, and an eyelet formed at the opposing end.

Figure 3:
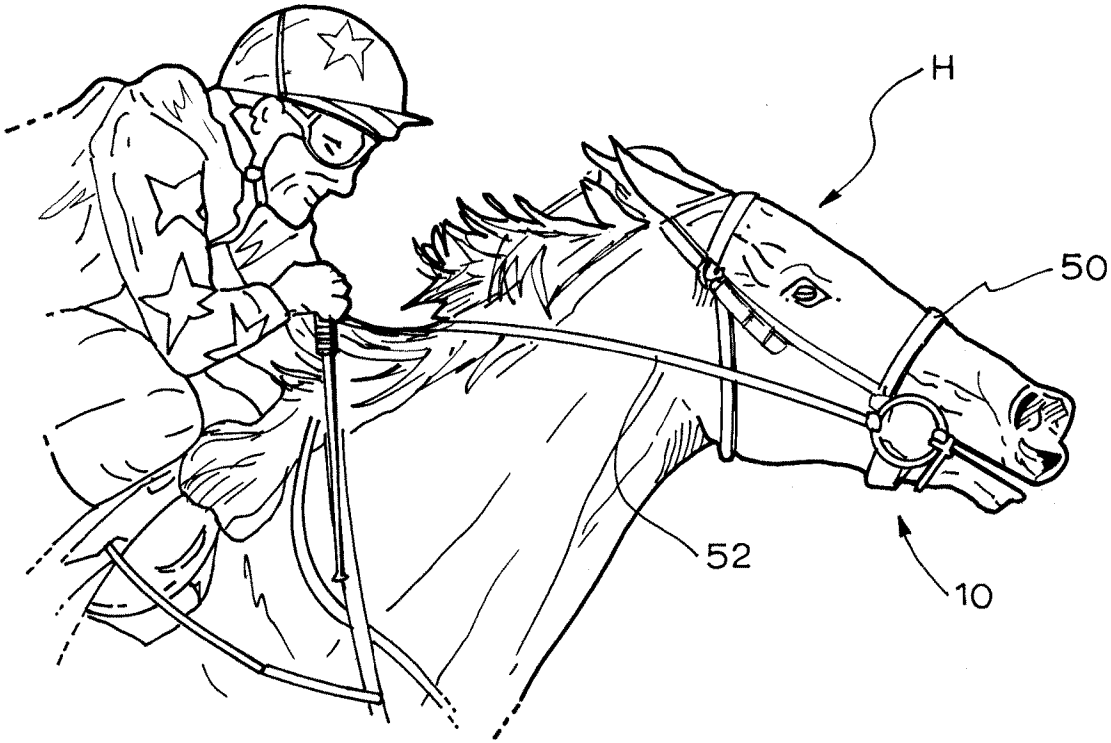
FIG. 3: is a side view of a horse wearing headgear in accordance with a second embodiment of the present invention.

FIG. 3 shows a horse H that is wearing headgear that includes a bridle 50, reins 52, and the bit 10 of the embodiment described in connection with FIGS. 1 and 2. As can be seen in FIG. 3, the loop member is positioned beneath the horse's lower jaw.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

The invention claimed is:

1. A bit for use in headgear for directing an animal, the bit comprising:

a pair of rings to which reins of the headgear are to attach;

a jointed mouthpiece with apertures that each extend through the mouthpiece and are each adjacent a respective one of two opposing ends of the mouthpiece for connection to a respective one of the rings such that each ring extends through the respective aperture, and at least one joint between the apertures that allows the mouthpiece to articulate between an undeflected position in which the apertures have a maximum separation, and deflected positions in which the separation of the apertures is less than the maximum separation, each ring passing through a respective one of the apertures such that the respective ring is rotatable relative to the mouthpiece; and a mouthpiece support that extends between the rings and limits the separation of the apertures to a minimum separation, the mouthpiece support including:

a cross bar that is to extend through the animal's mouth;

a pair of uprights that each have an upper end and a lower end, the upper end of each upright being connected to the cross bar; and a pair of fixed loops that are each connected to the lower end of a respective one of the uprights, and each fixed loop defining an opening through which one of the rings extends, wherein interference between the mouthpiece, the uprights and the rings limits the minimum separation of the apertures.

2. A bit according to claim 1, wherein the fixed loops form shoulders on which the mouthpiece rests.

3. A bit according to either claim 1, wherein the height of each uprights is greater than the thickness of the mouthpiece at the apertures.

4. A bit according to claim 1, wherein each fixed loop is arranged such that the largest dimension of the respective opening extends generally transversely to the cross bar and the uprights.

5. A bit according to claim 1, wherein the length of the opening defined by each of the fixed loops is such that the rings can freely rotate when the mouthpiece is in any of the undeflected or deflected positions.

6. A bit according to claim 1, wherein the cross bar has an arc shape such that the mouthpiece articulates beneath the cross bar.

7. A bit according to claim 1, wherein the mouthpiece support includes a loop member that is connected to the uprights and is to extend underneath the animal's lower jaw.

8. A bit according to claim 7, wherein the crossbar, the uprights and the loop member form a continuous ring.

9. A bit according to claim 8, wherein the fixed loops are welded to the continuous ring.

10. A bit according to claim 1, further-comprising a retaining ring that extends around the cross bar and through a central portion of the mouthpiece to retain the mouthpiece in close proximity to the cross bar.

11. A bit according to claim 10, wherein the mouthpiece has a single joint formed by two opposing interlinked loops, and wherein the retaining ring extends through one of the loops.

12. A bit according to claim 1, wherein each of the rings is circular.

13. A bit according to claim 1, wherein each of the rings has a diameter of at least 10 centimeters.

14. Headgear for directing an animal, the headgear comprising a bit according to claim 1.

* * * * *